United States Patent [19]

Athanasiou et al.

[11] Patent Number: 5,038,696

[45] Date of Patent: Aug. 13, 1991

[54] SHIP'S HULL HAVING MONOHULL FOREBODY AND CATAMARAN AFTERBODY

[75] Inventors: Al Athanasiou, New York, N.Y.; Thomas E. Fexas, Palm City, Fla.; James P. Campe, Oakland, Calif.

[73] Assignee: Advanced Composite Marine, Inc., New York, N.Y.

[21] Appl. No.: 472,326

[22] Filed: Jan. 30, 1990

[51] Int. Cl.[5] ..... B63B 1/00

[52] U.S. Cl. ..... 114/56; 114/61

[58] Field of Search ..... 114/56, 61, 62, 271, 114/283, 288-291

[56] References Cited

U.S. PATENT DOCUMENTS

| | | | |
|---|---|---|---|
| 3,040,687 | 6/1962 | Huet | 114/56 |
| 4,022,143 | 5/1977 | Krenzler | 114/56 |

FOREIGN PATENT DOCUMENTS

| | | | |
|---|---|---|---|
| 2571330 | 4/1986 | France | 114/291 |
| 2604412 | 4/1988 | France | 114/289 |
| 0138193 | 12/1978 | Japan | 114/61 |
| 0214089 | 9/1987 | Japan | 114/61 |
| 8808387 | 11/1988 | PCT Int'l Appl. | 114/291 |

*Primary Examiner*—Ed Swinehart

*Attorney, Agent, or Firm*—Ostrolenk, Faber, Gerb & Soffen

[57] ABSTRACT

A ship's hull is constructed of a monohull forebody shaped to be lifted upwardly as the ship speeds through the water and a catamaran afterbody which extends to rear of the monohull forebody. A deck disposed over a tunnel defined between a pair of catamaran hulls which comprise the hull's catamaran afterbody is constructed and positioned to support most of the load of the ship thereon. Venting ducts extend from the deepest point at the boundary region between the monohull forebody and the catamaran afterbody to a location on the ship which remains at all times above water level. The venting ducts serve to maintain atmospheric pressure conditions within the tunnel. This prevents formation of undesirable subpressure conditions in the tunnel which if permitted to develop would interfere with the ability of the monohull to lift as the ship is accelereated.

11 Claims, 4 Drawing Sheets

SHIP'S HULL HAVING MONOHULL FOREBODY AND CATAMARAN AFTERBODY

BACKGROUND OF THE INVENTION

The present invention relates to a ship's hull and more particularly relates to a hull which is constructed of a monohull forebody and a catamaran afterbody.

The hull of virtually all conventional ships and boats has a so-called monohull-configuration. The term "monohull" denotes a hull which is constructed of a single water displacing body. A monohull typically narrows in cross-section toward the front thereof to define a pointed bow which facilitates the ship's ability to cut efficiently through the water. But a monohull is otherwise relatively wide and a good portion thereof remains submerged at all times below the water surface. This enables a monohull to withstand and to remain more stable in rough seas. However, because a large portion of the monohull is submerged at all times, a monohull produces greater drag at high speeds, i.e. resistance to motion, which results in a ship whose top speed is limited and/or which requires more powerful engines.

A catamaran is a type of a ship which has a different hull structure which has been known for a long time to reduce drag and to result in a faster ship or boat. The hull of a catamaran consists of a pair of hulls each of which is comparatively narrow and long. The catamaran hulls are laterally spaced and typically held together by the deck or by the superstructure of the ship.

Catamarans offer the advantages of reduced drag which permit catamarans to attain speeds not possible with a monohull and/or the option of being equipped with less powerful and therefore less expensive engines. However, as is well known to those skilled in the marine arts, catamarans suffer from the serious disadvantage that they are considerably less stable in rough seas and from a propensity for submarining their forward hulls into large head seas which can result in the forward end of the hull "digging in" and the vessel flipping end for end.

SUMMARY OF THE INVENTION

Accordingly, it is an object of the present invention to provide a hull for ships and boats which enjoys the advantages and avoids the disadvantages of both a monohull and a catamaran.

It is a further object of the present invention to provide a ship's hull which improves a ship's performance in both calm and stormy seas.

It is yet another object of the present invention to provide a hull which is comprised of a monohull forebody and a catamaran afterbody, in an arrangement and configuration wherein the load of the ship will be substantially borne on the catamaran afterbody.

It is still another object of the invention to provide a ship or a boat having a hull which requires less fuel than a monohull to propel it through the water.

The foregoing and other objects of the present invention are realized by a ship's hull which is comprised of two hull portions including a monohull forebody which is shaped so that it rises in the water as the ship is accelerated and a catamaran afterbody. In conventional manner, the catamaran afterbody is comprised of first and second, spaced apart catamaran hulls. These hulls are, however, integrally connected, in accordance with the teachings of the present invention, with the monohull forebody in a manner whereby they extend smoothly from the rear of the monohull, defining between them a tunnel.

In addition to its customary function of providing personnel and cargo space, the deck of the ship or its superstructure serves in the context of the present invention to join the catamaran hulls to one another and also to cover the tunnel between the spaced catamaran hulls. Furthermore, in accordance with the present invention, the catamaran afterbody is constructed and sized to carry and to support thereon the major portion and preferably substantially the entirety of the load which the ship is intended to carry.

A monohull rises in the water at relatively high speeds, as is familiar from observing racing boats. The present invention is designed to take advantage of this effect by allowing the load of a ship to be borne on the catamaran afterbody at higher ship speeds and the monohull to more easily rise in the water. In this manner, the monohull forebody has a lesser effect when the ship is moving faster and a greater effect at slower speeds. Consequently, the present invention results in a hull which is capable of traveling faster and smoother through rough water and of attaining speeds which would have been impossible with a monohull alone. Also, the hull of the present invention requires less power than a monohull to propel it through the water, enabling a ship equipped with the hull of the present invention to be operated more efficiently and/or to be equipped with less powerful and therefore more economical engines.

In accordance with the salient feature of the present invention, a venting means is disposed in the tunnel between the catamaran hulls, preferably at the boundary region where the monohull forebody and the catamaran afterbody meet one another. The venting means preferably extends from the lowermost, i.e. deepest, point in the boundary region to a point on the hull or on the ship which remains located above water at all times. With this feature, the tendency to develop subatmospheric pressure conditions within the initially submerged tunnel as the monohull forebody begins to rise is effectively prevented as a result of the constant venting of the tunnel through the venting means.

In accordance with a preferred embodiment of the invention, the monohull forebody is about equal in length to the catamaran afterbody. Further, it is preferred that the monohull incorporate in it a plurality of chines on its exterior surface. These chines serve both to provide added lift to the monohull forebody as well as to push aside water, i.e. prevent or at least reduce unnecessary and undesired spraying of water. Similar chines are also provided on the catamaran afterbody, preferably on the walls thereof which face into the tunnel.

Other features and advantages of the present invention will become apparent from the following description of the invention which refers to the accompanying drawings.

DETAILED DESCRIPTION OF THE PREFERRED EMBODIMENT

Figure 1:
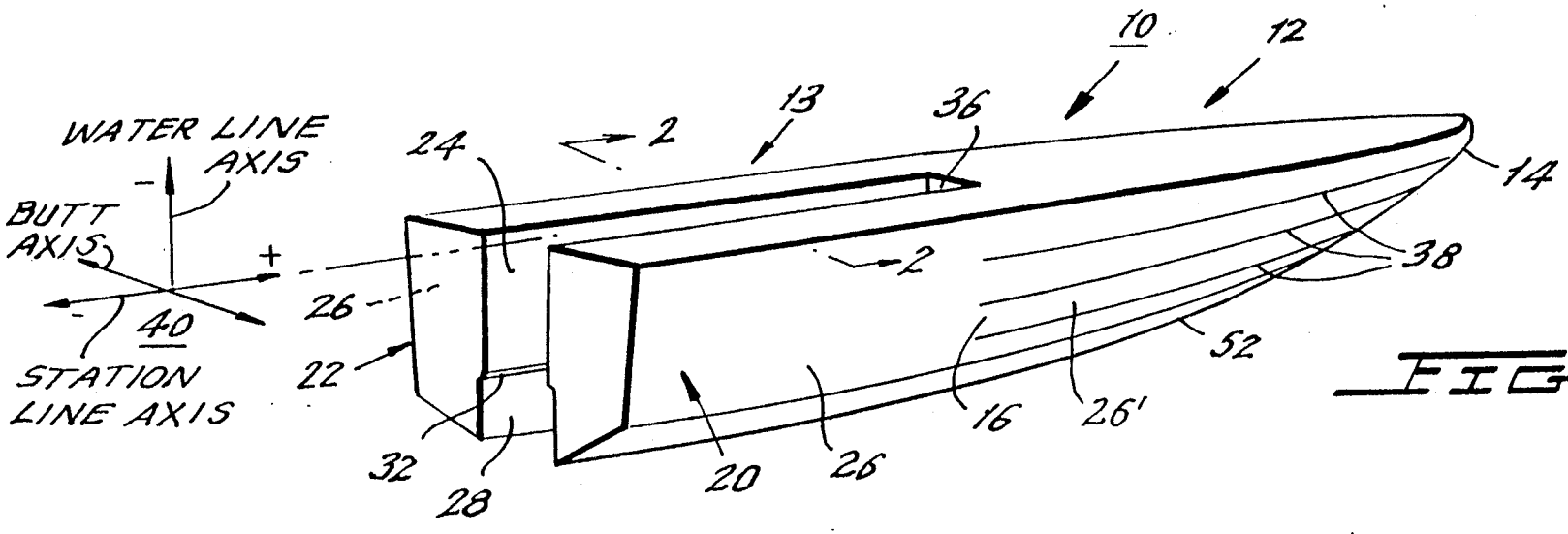
FIG. 1 is a perspective of a hull of a ship having a monohull forebody and a catamaran afterbody in accordance with the present invention.

Referring to the Figures, a ship's hull 10 in accordance with the present invention is comprised of a monohull forebody 12 and a catamaran afterbody 18. The monohull forebody 12 extends from the bow 14 of the hull 10 to about the middle region 16 thereof, the rest of the hull 10 being comprised of the catamaran afterbody 18 which extends smoothly from the monohull forebody 12 to the rear of each hull (20 and 22).

While the present Figures illustrate only the hull 10, it is to be understood that a fully constructed boat or ship which has the novel hull 10 of the present invention will also have a deck (not shown) or a superstructure to provide personnel and cargo compartments or space (not shown). It is also contemplated that a ship constructed to enjoy the advantages of the hull 10 will have the aforementioned tunnel 24 between the catamaran hulls 20 and 22 covered by the deck and that the catamaran afterbody 18 will, furthermore, have a size and a water displacing capacity which would enable it to carry most of the load of the ship thereon.

Under normal conditions, with the ship at a standstill, most if not the entirety of the tunnel 24 will be submerged in water. This attribute is important in order to appreciate the significance of a to be described venting means 34 which is provided at the boundary region between the monohull forebody 12 and the catamaran afterbody 18.

Figure 2:
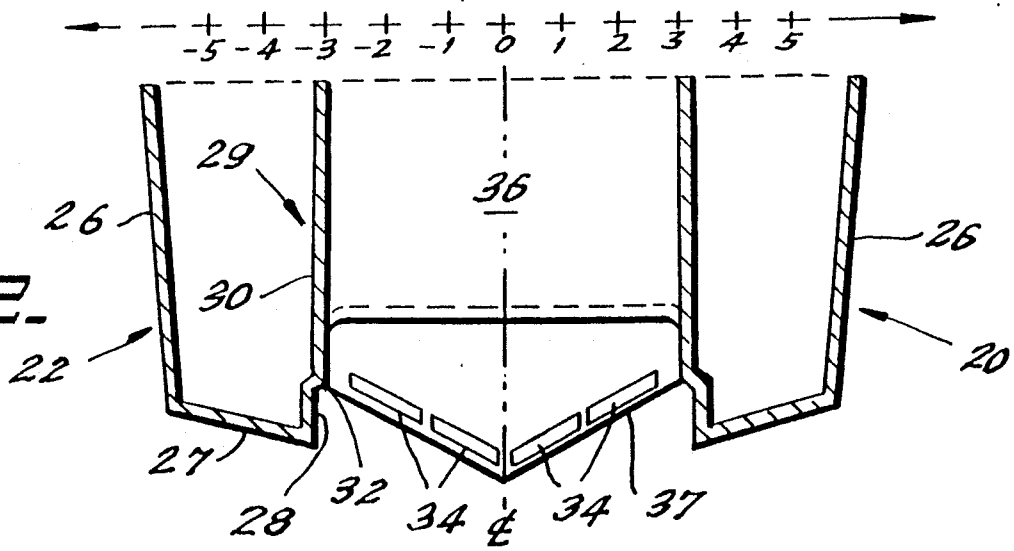
FIG. 2 is a cross-sectional view as seen along the arrows 2—2 in FIG. 1.

FIG. 2 presents an athwartship cross-section through the catamaran afterbody 18, at the location of the arrows 2—2, which illustrates that each of the catamaran hulls 20 and 22 possesses an outer, generally vertical but slightly inwardly tapering wall 26, a generally horizontally extending keel wall 27 which slopes gently downwards from the side wall 26, and an inner wall 29 which faces into the tunnel 24. The inner wall 29 is comprised of a first vertical section 28, a second vertical wall section 30 and a step 32, i.e. a horizontal indentation, between the wall sections 28 and 30. Preferably, the step 32 tapers down in size toward the boundary region 16.

As previously described, the catamaran hulls 20 and 22 are integrally connected with the monohull forebody 12 whereby then extend smoothly from the rear of the monohull. It was also explained (at the first paragraph following the caption DETAILED DESCRIPTION OF THE PREFERRED EMBODIMENT) that the present invention is directed to a single ship's hull 10 which is comprised of a monohull forebody 12 and a catamaran afterbody 18 and that the catamaran afterbody 18 extends smoothly from the monohull forebody 12. The foregoing is reflected in FIG. 1 which shows that the outer walls 26 of the catamaran hulls 20 and 22 extend smoothly from the outer walls 26' of the forebody 12.

The structure in the background, between the catamaran hulls 20 and 22, represents the V-shaped bottom 37 of the end wall 36 of the monohull forebody 12, as seen through the tunnel 24.

The propulsion engines for the hull 10 may be located at any of several suitable locations on the hull 10 including at the rear of each hull 20, 22.

On each side thereof the monohull forebody 12 has a set of three chines 38, referred to by some as "spray rails", which are constituted of inwardly indented steps in the surface of the hull 10 which serve the dual functions of providing a degree of lift for the hull 10 as the hull is accelerated through the water but, more importantly, to push water away from the hull 10 as it cuts through the water. This same function is also obtained from the aforementioned steps 32 which appear on the inside facing endwall 29 on the catamaran side hulls 20 and 22, as depicted in FIG. 2.

A key advantage of the hull 10 of the present invention derives from the provision therein of a plurality of venting ducts 34 which extend, at least partially, adjacent or along the rear wall 36 of the monohull forebody 12 and which have venting duct openings which face into the tunnel 24. Preferably, the venting ducts 34 extend from the lowermost point in the boundary region 16 between the monohull forebody 12 and the catamaran afterbody 18 to provide an airpath from the tunnel 24 to the deck or to another location on the ship which remains at all times above water. The advantage of the venting ducts 34 derives from the fact that the monohull forebody 12 begins to rise slowly out of the water as the ship is accelerated. This in turn causes the water level in the tunnel 24 to recede and more and more of the load of the ship to be carried on, i.e. supported by, the catamaran afterbody 18.

However, without the venting ducts 34, the receding water level would have created subpressure conditions in the tunnel 24 which would have then interfered with the ability with the monohull forebody 12 to rise further relative to the water. By providing the aforementioned venting ducts 34, the problem has been alleviated by allowing atmospheric air to flow into the tunnel 24, enabling the monohull forebody 12 to rise unhindered.

Figure 3:
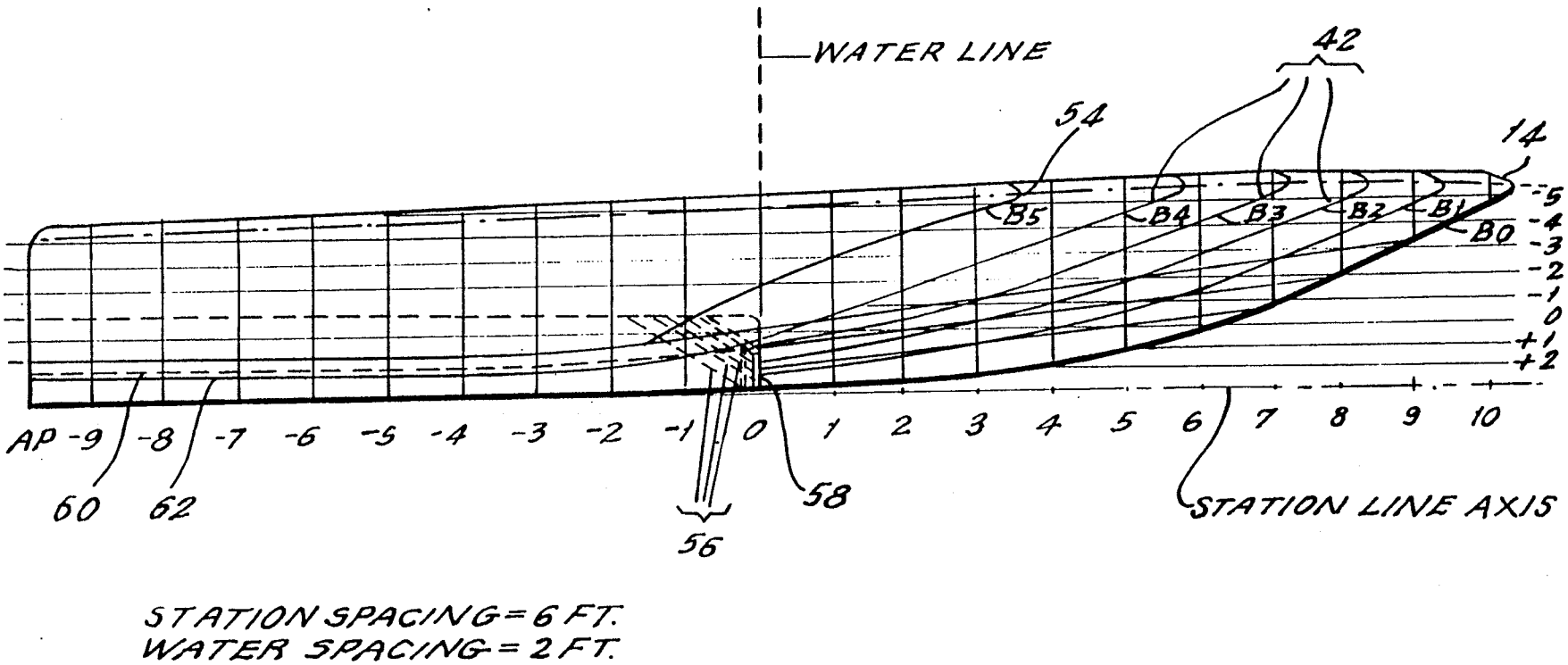
FIG. 3 is a profile view of surface coordinate values of the hull of the present invention plotted on a two-dimensional coordinate system comprised of the length and height axes of the ship's hull.
Figure 4:
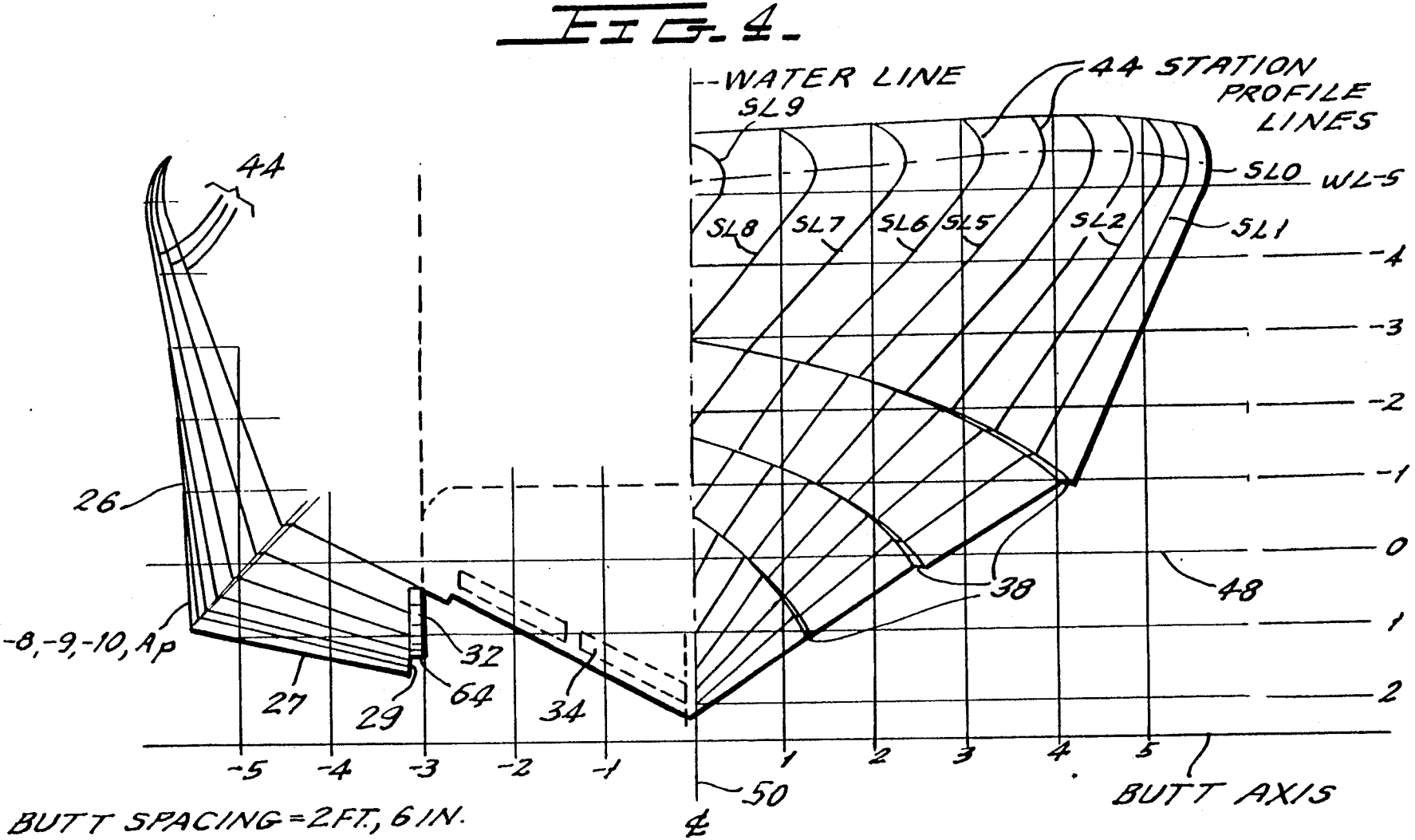
FIG. 4 is a body plan comprising an athwartship cross-sectional view of the hull, forward and aft of station 0, as depicted in FIG. 3. The sections at the right in FIG. 4 are forward of station 0 and the sections at the left of FIG. 4 are aft of station 0.
Figure 5:
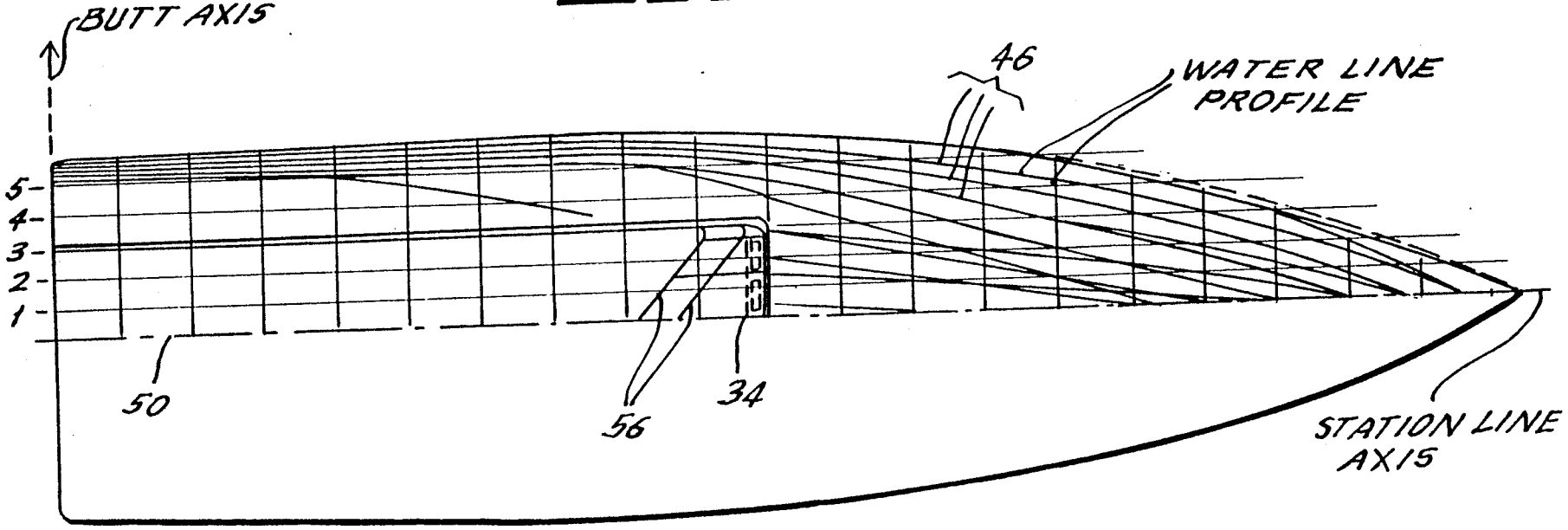
FIG. 5 is a plan view of the hull of the present invention in which the surface coordinate values of the hull are plotted on a coordinate system comprised of the length and width axes of the hull.

The three-dimensional coordinate system 40 which is sketched at the left-hand side in FIG. 1, next to the hull 10, serves to facilitate understanding of FIGS. 3–5. As is customary in the ship building industry, the shape and precise contour of a hull 10 is defined in FIGS. 3–5 in terms of a set of hull lines. Such hull lines are generated by plotting the surface coordinate values of the hull 10 along each axis thereof, e.g. the "x" axis, on a two-dimensional coordinate system made up of the remaining two axes, i.e. the "y" and "z" axes, where in FIGS. 3–5 "x", "y", "z" respectively correspond to the "station line" axis, the "butt" axis, and the "water line" axis. More specifically, FIGS. 3–5 respectively illustrate buttocks 42 (FIG. 3), stations 44 (FIG. 4), and water lines (hull height) 46 (FIG. 5).

Referring to FIG. 3, the hull 10 is defined in terms of buttock lines 42 which are plotted on a two-dimensional coordinate system which is comprised of the station line axis as the abscissa and the water line axis as the ordinate. As is apparent, the station line axis extends along the length of the hull 10 with positive station line values extending from about the middle of the hull 10 toward the bow 14 thereof or, in other words, essentially along the monohull forebody 12. The catamaran afterbody 18 is, on the other hand, associated in FIGS. 3–5 with negative station line values.

As best seen in FIG. 4, the water line coordinate axis extends along the height of the hull 10 with the negative values thereof denoting height above a reference water line 48. The water line axis has a value of zero at the reference water line and positive values below it. The third coordinate axis extends athwartship and is referred to as the buttock (BUTT) axis. Butt values are always positive port and starboard due to symmetry about the centerline.

A prototype of the invention, presently being constructed, will have the shape and dimensional proportions as shown in FIGS. 3–5. Thus, the set of butt lines 42 in FIG. 3 (B-1, B-2, B-3, B-4, and B-5) provide information which defines the shape of the monohull forebody 12. For example, the butt line B-5 denotes those locations on the hull 10 where the hull is almost at its widest, i.e. where the surface coordinate values on the hull 10 have a "butt" value of 5.

From the B-5 curve, it is also possible to deduce that all points on the hull 10 which are located between the station line 4 and the bow 14 have width, i.e., butt, coordinate values which are smaller than 5. The peak 54 on the curved profile line B-5 shows the location where the frame of the hull begins to narrow in cross-section. Similar information is contained in the other butt lines. For example, the butt line B-3 shows that the surface portion of the hull 10, which is located at the butt value of 3, extends further toward the bow 14, reflecting the fact that the monohull forebody 12 narrows gradually from its midregion 16 to the bow 14 thereof.

The negative sloped straight lines 56 which are disposed to the left of the boundary line 58 between the monohull forebody 12 and the catamaran afterbody 18 define the contour of the end wall 36 of the monohull forebody 12, as seen from the direction of the tunnel 34 looking along the longitudinal center line 50.

Dimensional information about the previously mentioned steps 32 which are formed in the inner wall 29 of the catamaran hulls 20 and 22 are provided in FIG. 3 by a pair of nearly parallel lines including the dashed line 60 and the solid line 62. In more accurately drawn manufacturing plans, the lines 60 and 62 reveal that the steps 32 taper up in height as they near the boundary line 58. In FIG. 4, the steps 32 are indicated by reference numeral 64.

Referring now to FIG. 4, the right-hand side of the Figure contains a plurality of cross-section station lines SL0–SL9 which illustrate the athwartship configuration of the hull 10 at a different location along its length or, in other words, at cross-sections located at different station line values. For example, the station line SL9 essentially represents the cross-section at the region of the bow 14, and reveals that the bow 14 is located high above the water, approximately between water line values −4.5 to −5.5. At the cross-section which is located at station line 5 (represented by SL5), the bottom of the hull 10 is just about at the water line level (WL=0). FIG. 4 also illustrates the locations of the chines 38 relative to the cross-section station lines 44.

The left hand side in FIG. 4, shows the athwartship configurations at those stations line values which are generally associated with the catamaran afterbody 18. Thus, at station lines −6, −9, −10 and AP (see FIG. 3), FIG. 4 illustrates the previously mentioned wall portions of the catamaran hull 20 including the nearly vertical wall 26, the generally horizontal bottom surface 27, and the inward facing sidewall 29 which has formed in it the steps 32.

FIG. 5 supplements the views provided by FIGS. 3 and 4 to further define the shape of the hull 10. Thus, in FIG. 5, the shape of the water line coordinate values is plotted on a two-dimensional coordinate system which consists of the length (station line axis) and the width (butt axis) of the hull 10. Thus, as is apparent from viewing the hull 10 which has been perspectively sketched in FIG. 1, all the water lines are located close together at the hull sides of the catamaran afterbody 18 because the width of the hull 10 there is essentially constant. These same profile lines begin to diverge, however, as seen on the right hand side of FIG. 5, as they start to extend along the monohull forebody 12, indicative of the fact that the monohull forebody narrows gradually toward the bow 14.

In the particular embodiment which is illustrated in FIGS. 3–5, the spacing between the station lines is about six feet, indicating that the ship will have a length of about 120 feet.

Further, the butt lines in the Figures preferably have a spacing of two feet, six inches and the water lines a spacing of two feet, indicating that a ship constructed according to the plans of FIGS. 3–5 will have a width of about thirty feet and a height of about 18 feet.

Thus, a ship constructed to have a hull 10 in accordance with the present invention will have achieved the key objectives thereof. Such a ship will have its monohull forebody 12 more deeply submerged in water as the ship is moving relatively slowly as it would during stormy weather when seas are rough, providing the desired seaworthiness. However, as the ship is accelerated, the monohull forebody 12 thereof will slowly rise in the water causing the ship to be essentially supported on its catamaran afterbody 18. Therefore, at faster speeds, the advantages of the catamaran afterbody 18 will begin to predominate, reducing drag and enabling a greater portion of thrust developed by the engines to translate into forward speed. Alternatively, a ship constructed with a hull 10 of the present invention might be built with less powerful and therefore more economical engines, resulting in a more efficient running of the ship.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A ship's hull, comprising:

a generally V-shaped monohull forebody shaped to rise in the water above a predetermined reference water level upon being propelled forwardly at a speed exceeding a predetermined speed, said monohull forebody extending over substantially half of the length of the hull and having outer walls defining said monohull forebody;

a catamaran afterbody, including first and second, spaced apart, catamaran hulls, the catamaran hulls extending from the monohull forebody rearwardly relative thereto and defining a tunnel therebetween, each said catamaran hull having a respective outer wall and each said respective outer wall extending smoothly from a respective one of said outer walls of said monohull forebody, the catamaran afterbody being constructed to carry and to support on it at least the major portion of a load to be carried by the ship's hull, said catamaran afterbody not extending into the monohull forebody;

deck means extending between and over the tunnel and joining the catamaran hulls; and venting means having a first end adjacent a boundary region between the monohull forebody and the catamaran afterbody and a second end which remains at all times above water level for maintaining atmospheric pressure conditions at the boundary region and in the tunnel.

2. The ship's hull of claim 1, wherein the boundary region is disposed about longitudinally midway along a length dimension of the hull.

3. The ship's hull of claim 1, further comprising a plurality of chines on the exterior surface of the monohull forebody.

4. The ship's hull of claim 3, wherein the chines include first, second and third chines and said chines extend from a bow region on the monohull forebody and extend generally in a rearwardly and downwardly direction therefrom.

5. The ship's hull of claim 1, wherein the monohull forebody has a lowermost point at the boundary region and wherein the first end of the venting means is disposed adjacent the lowermost point.

6. The ship's hull of claim 1, wherein the hull has a capacity of greater than about 150 tons.

7. The ship's hull of claim 6, wherein the ship's hull measures about 30 feet in width at the catamaran afterbody, is about 120 feet in length, and about 15 feet in height from the keel to a deck level thereof.

8. The ship's hull of claim 1, further comprising a rear wall at a rear end of said monohull forebody, each said catamaran hull having a respective inner wall, said tunnel being defined by said inner wall of said catamaran hulls and said rear wall of said monohull forebody.

9. The ship's hull of claim 8, wherein said first end of said venting means is disposed at said rear wall of said monohull forebody.

10. A ship's hull, comprising:

a monohull forebody shaped to rise in the water above a predetermined reference water level upon being propelled forwardly at a speed exceeding a predetermined speed;

a catamaran afterbody, including first and second, spaced apart, catamaran hulls, the catamaran hulls extending from the monohull forebody rearwardly relative thereto and defining a tunnel therebetween, the catamaran afterbody being constructed to carry and to support on it at least the major portion of a load to be carried by the ship's hull;

deck means extending between and over the tunnel and joining the catamaran hulls;

vending means having a first end adjacent a boundary region between the monohull forebody and the catamaran afterbody and a second end which remains at all times above water level for maintaining atmospheric pressure conditions at the boundary region and in the tunnel;

a plurality of chines on the exterior surface of the monohull forebody; and a step in each of the catamaran hulls on a side wall thereof facing the tunnel.

11. The ship's hull of claim 5, wherein the size of the step tapers down toward the boundary region.

* * * * *